US005881347A

United States Patent [19]

May et al.

[11] Patent Number: 5,881,347

[45] Date of Patent: *Mar. 9, 1999

[54] BIASING METHOD AND APPARATUS FOR ELECTROSTATICALLY TRANSFERRING AN IMAGE

[75] Inventors: John W. May, Rochester; Thomas N. Tombs, Brockport; Bruce R. Benwood, Churchville, all of N.Y.

[73] Assignee: Eastman Kodak Company, Rochester, N.Y.

[ * ] Notice: The term of this patent shall not extend beyond the expiration date of Pat. No. 5,724,636.

[21] Appl. No.: 837,630

[22] Filed: Apr. 21, 1997

[51] Int. Cl.[6] ..... G03G 15/01; G03G 15/16

[52] U.S. Cl. ..... 399/302; 399/308; 399/313; 399/314

[58] Field of Search ..... 399/302, 308, 399/313, 314, 315

[56] References Cited

U.S. PATENT DOCUMENTS

| | | | |
|---|---|---|---|
| 3,781,105 | 12/1973 | Meager . | |
| 3,830,589 | 8/1974 | Allen . | |
| 3,832,053 | 8/1974 | Goel et al. . | |
| 3,860,857 | 1/1975 | Namiki et al. . | |
| 4,098,227 | 7/1978 | Thompson . | |
| 4,338,017 | 7/1982 | Nishikawa | 399/313 X |
| 4,401,383 | 8/1983 | Suzuki et al. . | |
| 5,040,028 | 8/1991 | Kamimura et al. | 399/302 |
| 5,187,526 | 2/1993 | Zaretsky . | |
| 5,189,479 | 2/1993 | Matsuda et al. . | |
| 5,276,490 | 1/1994 | Bartholmae et al. . | |
| 5,287,152 | 2/1994 | Oka et al. . | |
| 5,303,013 | 4/1994 | Kaiko et al. . | |
| 5,321,477 | 6/1994 | Nagata et al. . | |
| 5,420,677 | 5/1995 | Gross et al. . | |
| 5,428,429 | 6/1995 | Fletcher . | |
| 5,442,429 | 8/1995 | Bartholmae et al. . | |
| 5,459,560 | 10/1995 | Bartholmae et al. . | |
| 5,461,461 | 10/1995 | Harasawa et al. . | |
| 5,724,636 | 3/1998 | Tombs et al. | 399/313 |
| 5,729,810 | 3/1998 | Bergen et al. . | |

OTHER PUBLICATIONS

R. M. Schaffert, Electrophotography, Focal Press, New York (1975) pp. 514–518.

U.S. application Ser. No. 08/745,728, filed Nov. 12, 1996, Tombs et al.

*Primary Examiner*—William Royer
*Attorney, Agent, or Firm*—Norman Rushefsky

[57] ABSTRACT

A method and apparatus for electrostatically transferring a toner image from a toner image bearing member (TIBM) to a receiver sheet is disclosed. A receiver sheet is moved within a nip defined between a transfer roller having a resistive outer layer and a toner image bearing member supporting a toner image. To provide for transfer, there is applied an electrical bias to the resistive layer from a conductive member located beneath the resistive layer and in electrical contact with the resistive layer. There are also applied to an outer surface of the resistive layer a first contact voltage to establish an post-nip electrical voltage distribution to a post-nip region of the transfer roller that is immediately downstream of an in-nip region. The post-nip electrical voltage distribution is accomplished by having the first contact voltage be applied at first points on the outer layer of the transfer roller, the first points being within or proximate the post-nip region. There is also applied to the resistive outer layer a second contact voltage to establish an electrical voltage distribution to a pre-nip region of the transfer roller immediately up-stream of the in-nip region. This pre-nip electrical voltage distribution is accomplished by having the contact voltage be applied at second points on the outer layer of the transfer roller, the second points being within or proximate the pre-nip region. The resistivity of the outer layer, the voltage provided to the conductive member, the voltage bias to the TIBM, and the first and second contact voltages establish an in-nip electrical field or voltage suitable for transfer of the toner image to a receiver sheet and for suppression or reduction of pre-nip and post-nip ionization.

24 Claims, 4 Drawing Sheets

BIASING METHOD AND APPARATUS FOR ELECTROSTATICALLY TRANSFERRING AN IMAGE

CROSS-REFERENCE TO RELATED APPLICATION

This application is related to U.S. application Ser. No. 08/745,728 filed in the names of the inventors hereof on Nov. 12, 1996 and now U.S. Pat. No. 5,724,636.

BACKGROUND OF THE INVENTION

This invention relates to electrostatography and more particularly to an improved method and apparatus for transferring toner images to receiver sheets.

Ideally, in transferring a toner image from an image-bearing member to a receiver sheet, the electrostatic transfer force on the toned image must be made as high as possible in the transfer nip. Increasing the applied electric field increases the electrostatic force. However, the electric field is limited by air breakdown (ionization) which occurs when the electric field exceeds the Paschen limit (see R. M. Schaffert, *Electrophotography,* Focal Press, New York (1975), pp. 514–518). While a small amount of ionization can be tolerated, excessive ionization causes image defects and reduces transfer efficiency.

Three distinct regions can be identified in the transfer region: pre-nip, in-nip, and post-nip (see FIG. 1). When using a conventional resistive transfer roller to transfer toner to a receiver the electric field in the air gaps and toner stacks increases as the image traverses the pre-nip and in-nip regions of the nip. In the post-nip region the electric field decreases as the image moves away from the nip. In the pre-nip region it is desirable to keep the magnitude of electric field low to prevent i) premature toner transfer across large air gaps, which blurs the image, and ii) pre-nip ionization, which causes image mottle and poor transfer efficiency. The electric field in the transfer nip (the in-nip region), however, must be larger than in the pre-nip region because this is where transfer of the toned image should occur. Ideally, the electric field in the transfer nip is made as large as possible without allowing significant ionization or pre-nip transfer. The electrical properties of the transfer roller must be carefully selected to maximize the electric field used for toner transfer and, at the same time, minimize the amount of ionization.

It is well known in the art to use a resistive transfer roller to optimize toner transfer from an imaging member to a final receiver (paper). Meager, U.S. Pat. No. 3,781,105 (1987) describes the use of a transfer roller for transferring toner images to a receiving sheet. This reference suggests the transfer roller have a blanket with a resistivity of $10^9$ to $10^{11}$ ohm-cm.

Bartholmae and Tompkins, U.S. Pat. No. 5,276,490 (1994) and Koike et al. U.S. Pat. No. 5,303,013 (1994) disclose the use of transfer rollers containing multiple parallel electrodes to aid paper handling and also to control the application of an electrical bias during the transfer of toner images.

Zaretsky, U.S. Pat. No. 5,187,526 (1993) points out that transfer can be improved by separately specifying the resistivity of an intermediate transfer roller and a second transfer roller, which form a nip for transfer to paper.

One difficulty encountered by the aforementioned techniques of utilizing transfer rollers is the limitation imposed by air breakdown (ionization) in the vicinity of the nip in which the toner is transferred to the receiver. Air breakdown degrades the transfer efficiency and image quality of toner images, especially multi-color images, by altering the quantity of charge on the toner particles. In practice, this problem is amplified because transfer rollers are typically doped with anti-stats or other conducting materials that are sensitive to fluctuations in temperature and relative humidity. There is a need to overcome these problems in order to improve the transfer to paper, especially for high quality color imaging and it is an object of the invention to provide a method and apparatus for transferring a toner image to a receiver sheet that overcomes or minimizes such problems.

SUMMARY OF THE INVENTION

In accordance with a first aspect of the invention, there is provided a method for electrostatically transferring a toner image from a toner image bearing member to a receiver sheet, the method comprising moving a receiver sheet within a nip defined between a toner image-bearing member supporting a toner image and a transfer roller having a conductive inner member and resistive outer layer; applying an internal voltage to the conductive inner member; applying a first contact voltage to the resistive outer layer at first points in or proximate to a post-nip region of the transfer roller that is immediately downstream of an in-nip region; applying a second contact voltage to the resistive outer layer at second points in or proximate to a pre-nip region of the transfer roller that is immediately up-stream of the in-nip region; applying a voltage to the toner image bearing member; and wherein the internal voltage, the first and second contact voltages, and the voltage on the toner image bearing member cooperate to define an in-nip voltage distribution suitable for transferring the toner image to the receiver sheet and respective pre-nip and post-nip voltage distributions that suppress or minimize pre-nip and post-nip ionization.

In accordance with a second aspect of the invention, there is provided an apparatus for electrostatically transferring a toner image from a toner image bearing member to a receiver sheet, the apparatus comprising a movable toner image bearing member supporting a toner image and biased to a first voltage level; a rotatable transfer roller located proximate the toner image bearing member so as to cooperate with the toner image bearing member to define a toner transfer nip for transferring the toner image to a receiver sheet moving within the nip, the transfer roller having a resistive outer layer and a conductive inner member that is electrically biased to a second voltage level; a first contact voltage applicator applying a first contact voltage to the resistive outer layer at first points in or proximate a post-nip region to establish a post-nip electrical voltage distribution in the post nip region of the transfer roller that is immediately downstream of an in-nip region of the transfer roller; a second contact voltage applicator applying a second contact voltage to the resistive outer layer at second points in or proximate a pre-nip region to establish a pre-nip electrical voltage distribution in the pre-nip region of the transfer roller that is immediately up-stream of the in-nip region; and the first voltage level, the second voltage level and the first and second contact voltages establishing an in-nip voltage distribution suitable for transferring the toner image to the receiver sheet.

The advantages of the method and apparatus of the invention are a reduction in pre-nip ionization and pre-nip transfer, which yields higher image quality and a more robust system. The invention also provides control of post-nip ionization and improved transfer latitude and flexibility while maintaining high transfer efficiency.

BRIEF DESCRIPTION OF THE DRAWINGS

In the detailed description of the preferred embodiments of the apparatus and method of the invention, reference is made to the accompanying drawings, in which.

DETAILED DESCRIPTION OF THE PREFERRED EMBODIMENTS

Because apparatus of the type described herein are well known, the present description will be directed in particular to elements forming part of or cooperating more directly with the present invention. The invention has particular utility with regard to copiers/duplicators/printers and in particular to transfer stations used therein.

Figure 1:
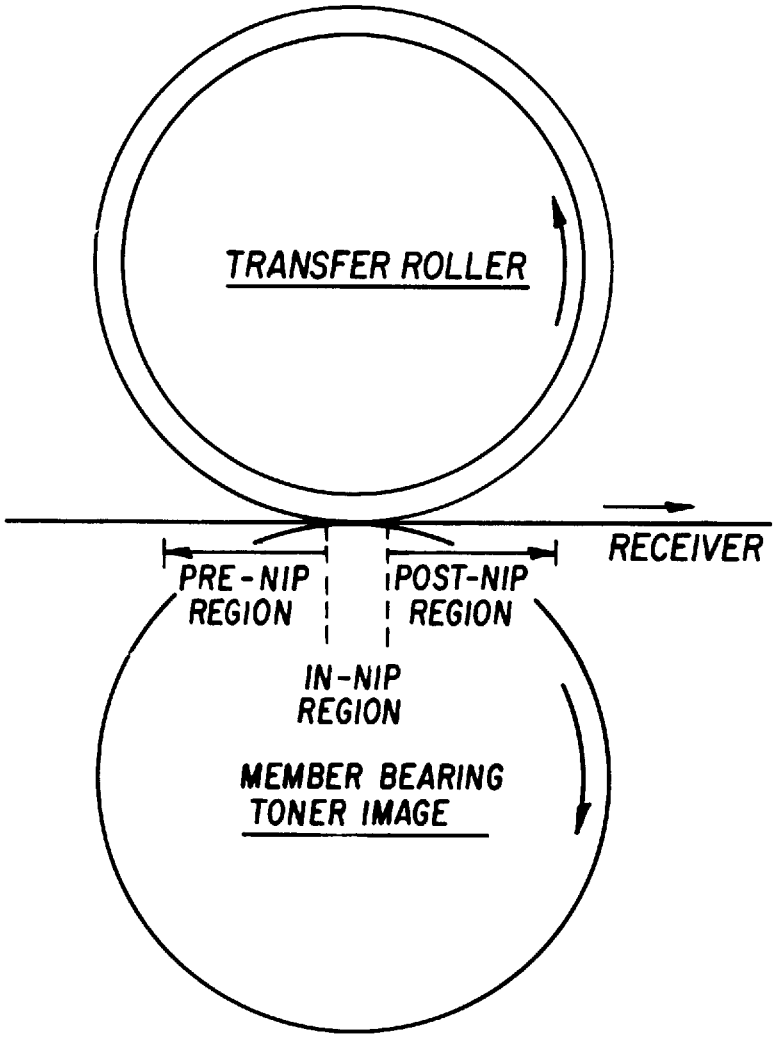
FIG. 1 is a schematic elevational view of a typical transfer station illustrating the location of the pre-nip, in-nip and post-nip regions of the transfer station.
Figure 2:
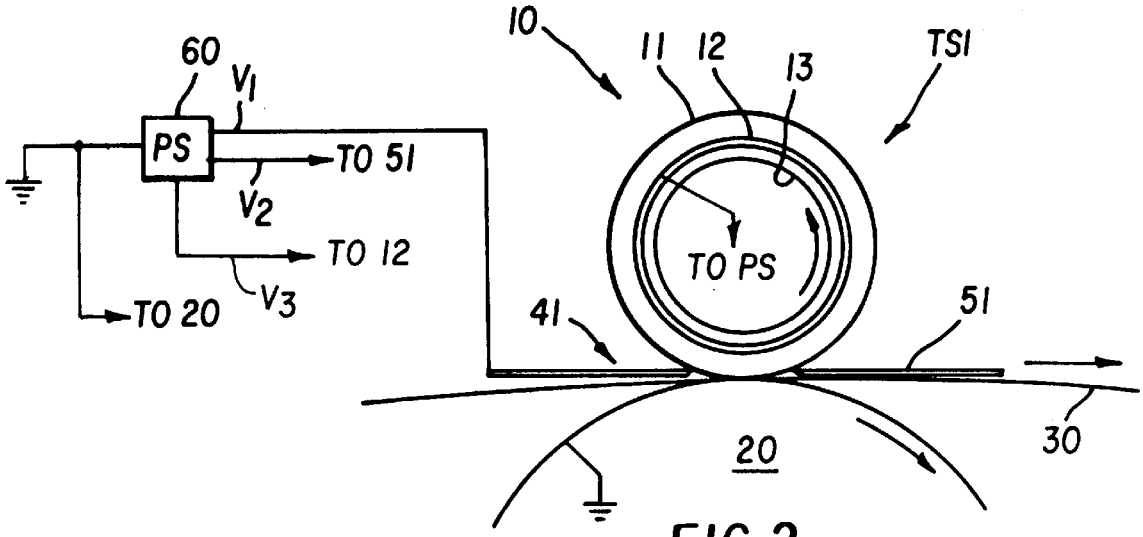
FIG. 2 is a schematic elevational view of a transfer station in accordance with one embodiment of the invention.

FIG. 2 shows a first embodiment of the invention. A transfer station apparatus, TS1, includes a cylindrical transfer roller 10 shown forming a nip with a toner image bearing member (TIBM) 20. In the following figures, the various layers of the transfer roller are not shown to scale; however, it is preferred as shown to have the transfer roller have a smaller diameter than the TIBM. Toner image bearing member 20 may be a primary imaging member of one or more layers, wherein a toner image is formed by photoconductive or electrographic means or by some other toner image generation means or process. Alternatively, TIBM 20 may be an intermediate transfer member wherein one or more toner images are formed on another primary imaging member and transferred to the TIBM for subsequent transfer to a receiver sheet. The TIBM 20 may support either a monocolor toner image or a multicolored image that is to be transferred to a receiver sheet 30 such as plain paper or a transparency sheet upon which the toner image is to be transferred and subsequently fused. The invention may also be useful in a copier/printer wherein plural monocolor images may be serially transferred to the same receiver sheet to form either a multicolor image or a composite image of different types of images or toner type, for example, magnetic and nonmagnetic toners. Suitable means, not shown, may be provided for rotating the TIBM 20. Where TIBM 20 is a primary electrostatographic image forming member, it preferably includes a photoconductive layer. Although the TIBM 20 is shown as a roller, it may also be a web. The conductive electrode or layer (not shown) of the TIBM is grounded or biased to some voltage.

The transfer roller 10 has a compliant resistive outer layer 11 on top of a supporting core 13. The core 13 is a rigid material, preferably hollow, and can be insulating or conducting. However, if the core is insulating, then an additional conductive layer 12 is required to electrically receive a voltage V3 from power supply (PS) 60. If the core is conductive, the voltage V3 is applied to the core which would be electrically isolated from ground potential. The following description assumes that the core is not electrically conductive and that a conductive layer 12 extends beneath the compliant resistive layer 12 for the full working length of the resistive layer. Voltages V1 and V2 are applied to the external surface of the transfer roller; i.e. to the outer surface of the resistive layer 11, by contacting the resistive layer's surface with electrical contact voltage applicators in the form of conductive blades in both the pre-nip 41 and the post-nip regions 51. The blades are preferably metal or other conductive material and run the full length of the transfer roller's resistive layer surface so that the respective biases impressed by power source 60 is uniform across the full working length of the transfer roller which is at least as long as the cross-track direction of the sheet 30. The receiver sheet when entering the nip may be advanced by frictional engagement with the driven TIBM 20. The surface of the receiver sheet in engagement with the transfer roller may be used to drive the transfer roller.

The power supply 60 may be, for example, a variable voltage power supply that provides different respective voltage bias levels V1, V2 (relative to ground) to the blades 41, 51, respectively, to establish the respective pre-nip and post-nip electrical potentials and in cooperation with the voltage V3 to conductive layer 12 to establish the in-nip voltage Vn. The blades can also aid paper handling.

In using blades to provide the biasing by contacting the external surface of the transfer roller 10, it is important that the post-nip blade 51 not dig into the surface. Thus, the tip of the blade may be formed with a surface configuration such as a rounded or bulb-like configuration to avoid binding with or abrading of the roller 10. Other alternatives that inhibit binding may include control of angle of attack of blade with roller surface and/or use of spring biasing.

Figure 3:
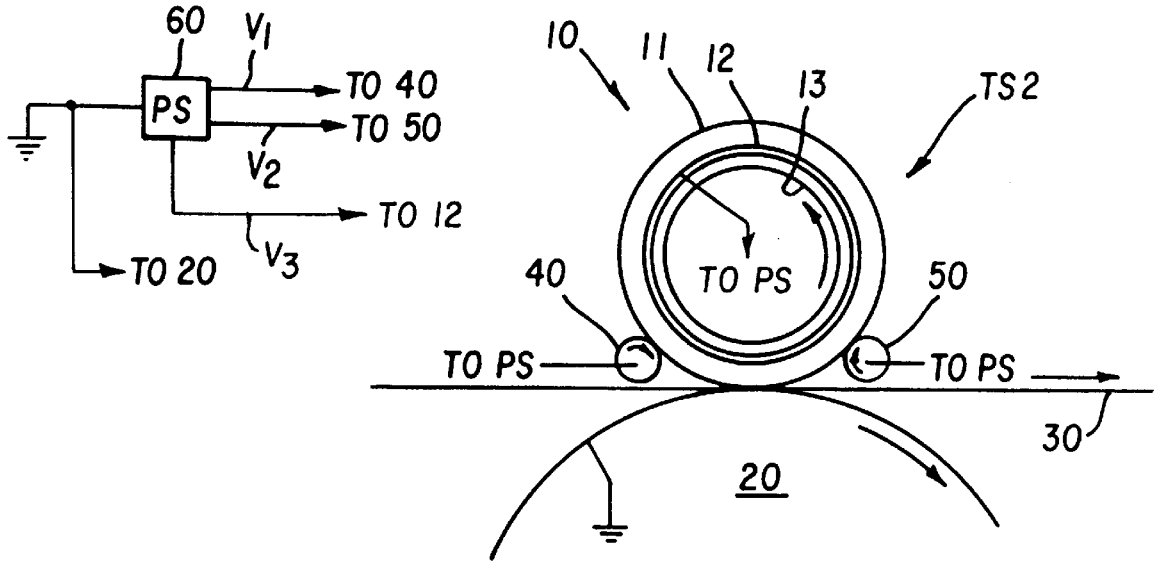
FIG. 3 is a schematic elevational view of a transfer station in accordance with a second embodiment of the invention.

FIG. 3 shows a second embodiment of the invention. In the transfer station, TS2 illustrated in FIG. 3, the only difference from the first embodiment is the specific device for applying the bias or voltage to the transfer roller surface. In this second embodiment where like numbers indicate similar structures to that of the first embodiment, rotating conductive biasing rollers, 40 and 50, are the electrical contact voltage applicators and are placed in contact with the resistive outer surface 11 of transfer roller 10 in the pre-nip and post-nip regions. The biasing rollers also extend for the full length of the resistive outer surface 11 of the transfer roller so that the bias is uniform across the full working length of the transfer roller. The biasing rollers 40 and 50 are connected to the power supply PS so that voltages V1 and V2 are respectively impressed upon the biasing rollers and transferred to the resistive outer surface 11 of the transfer roller. The biasing rollers may be idler rollers that rotate through frictional engagement with the transfer roller. The biasing rollers through contact with the surface of resistive layer 11 establish the respective pre-nip and post-nip electrical potentials and in cooperation with the potential to TIBM 20 and the voltage V3 to layer 12 to establish the in-nip voltage Vn.

Figure 4:
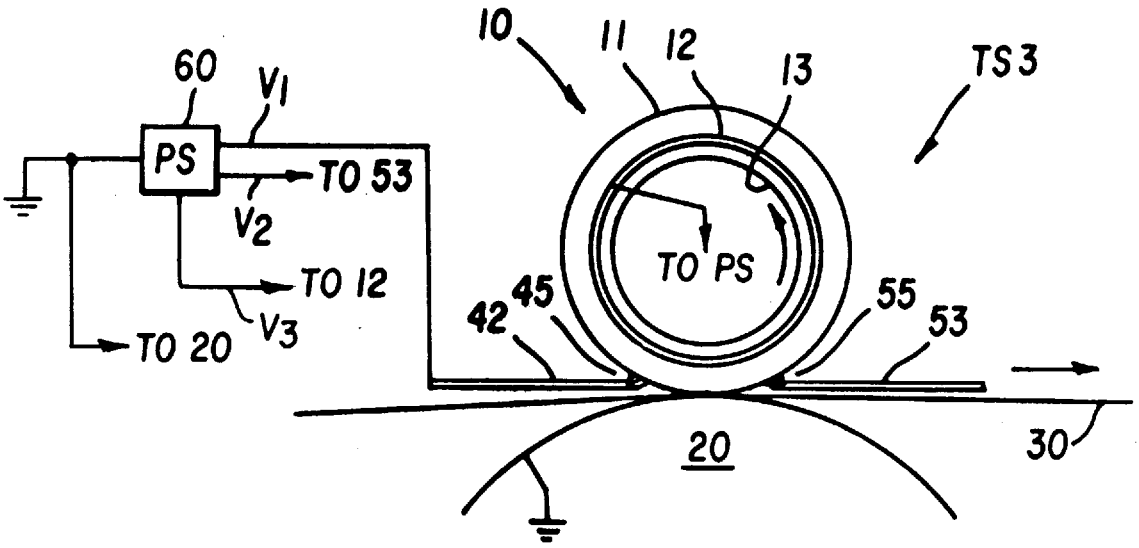
FIG. 4 is a schematic elevational view of a transfer station in accordance with a third embodiment of the invention.
Figure 6:
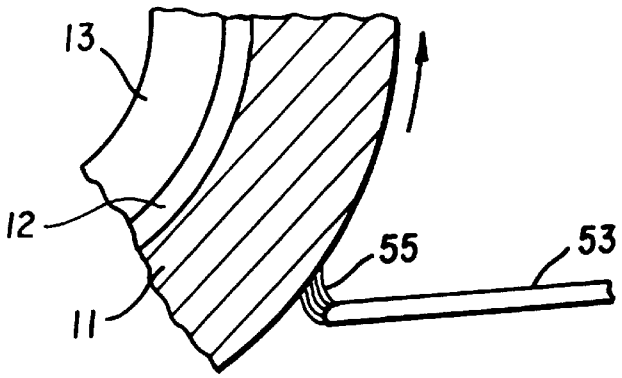
FIG. 6 is a schematic enlarged view of a portion of the transfer station of FIG. 4

With reference now to FIG. 4, there is shown a third embodiment of a transfer station, TS3, Like numbers in this figure to that of FIG. 2 represent similar structures. The electrical contact voltage applicators for the transfer roller 10 are in the form of electrical brushes 45 and 55 which are provided respectively at the end of conductive blades 42 and 53. The brushes are electrically connected to respective potentials of source 60 and engage the outer surface of resistive layer 11 of transfer roller 10 to thereby establish the respective pre-nip, in-nip and post-nip electrical potentials and cooperate with the voltage V3 to layer 12 to establish the in-nip voltage Vn. The brushes also extend for the full length of the resistive surface 11 of the transfer roller so that the bias is uniform across the full working length of the transfer roller. Brushes have the advantage of flexibility and thus may tend to impose less wear upon the transfer roller (see FIG. 6).

Figure 5:
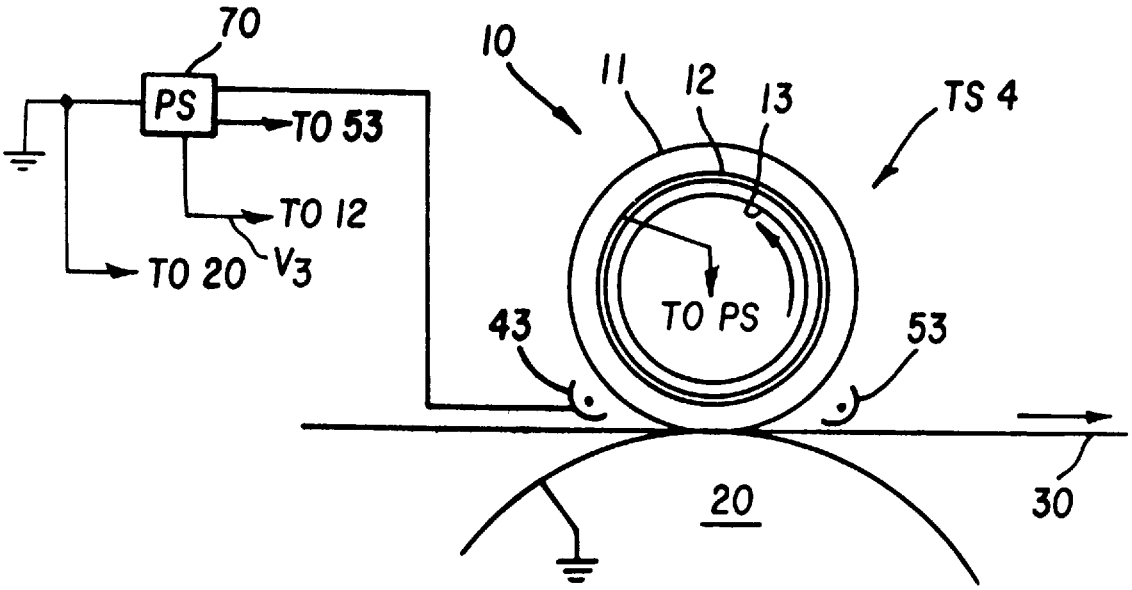
FIG. 5 is a schematic elevational view of a transfer station in accordance with a fourth embodiment of the invention.

With reference now to FIG. 5, there is shown a fourth embodiment of a transfer station, TS 4. Like numbers in this figure to that of FIG. 2 represent similar structures. The electrical contact voltage applicators for the transfer roller 10 are in the form of two corona chargers 43 and 53 which deposit respective charge at the pre-nip and post-nip regions to the surface of the transfer roller 10. The chargers 43 and 53 may be either pin or wire corona chargers or other chargers known in the art, including gridded chargers AC and/or DC chargers, and extend for the full working length of the outer surface of resistive layer 11. The charge from the corona chargers deposited onto the resistive layer 11 in cooperation with the voltage V3 to layer 12 establish the respective pre-nip, in-nip and post nip electrical potentials. A suitable corona charger power supply 70 applies respective voltages to the corona chargers to deliver the respective currents needed to establish these electrical potentials.

In all embodiments the electrical bias is applied so as to create a voltage profile in the resistive layer 11 which creates a sufficient electric field in the in-nip region to urge transfer of toner to the receiver and at the same time produces a small electric field in the pre-nip and post-nip regions to minimize pre-nip transfer and pre-nip and post-nip ionization. The electric field in the pre-nip region is set by applying a potential difference ($V_n$–$V_1$) between the pre-nip biasing means and the outer surface of the resistive layer at the in-nip region. Vn represents the potential at the outer surface of the resistive layer established by application of voltage potential bias V3 to the inner portion of the surface of the resistive layer and application of V1 and V2 at the respective pre-nip and post-nip locations. The potential applied to a contact voltage applicator in the pre-nip region is set so that the resulting electric field in the pre-nip region is small and, therefore, does not cause or minimizes ionization or pre-nip transfer. The voltage applied to the biasing means V3 for biasing the in-nip region is set to create the transfer field in the in-nip region, thus the magnitude is generally large, 500 V to 4000 V, and the polarity is opposite to that of the toner. The voltage distribution set in the post-nip region is lower than that in the in-nip region and is established by the potential difference ($V_n$–V2). The voltage distribution in the post-nip region is low enough to reduce ionization in the post-nip region The contact voltages V1 and V2 may be ground.

The optimum resistivity of layer 11 on the transfer roller depends on several factors including, the process speed, the thickness of the blanket material, and whether direct or intermediate transfer is being performed. The preferable range for the resistivity of layer 11 is from about $10^7$ to about $10^{12}$ ohm-cm. Suitable materials for layer 11 may include polyurethanes doped with antistats. Preferably, layer 11 is a compliant layer and may be provided with an optional overcoat (not shown) of suitable resistivity and having desirable release properties to aid cleaning.

The contact voltage applicators described above may require cleaning periodically and suitable means may be provided for this. In addition, means may be provided for precluding or lowering the likelihood of contamination of these applicators.

Thus, there has been shown a transfer station that may be implemented by various embodiments in which certain specific embodiments are described herein. The embodiments may have elements mixed so that, for example, a roller may be used at the post-nip position while a blade or brush or corona charger is used at a pre-nip position to apply the contact voltages for post-nip and pre-nip, respectively. Mixing of the various elements may be desirable because of mechanical fit considerations; e.g., for example some elements such as brushes, blade and pin chargers may be able to be positioned closer to the respective region for applying their respective contact voltages. As used herein, a corona charger is broadly considered a means for applying a contact voltage even though the charger itself would not contact the transfer roller, but the charge deposited by the charger does.

Figure 7:
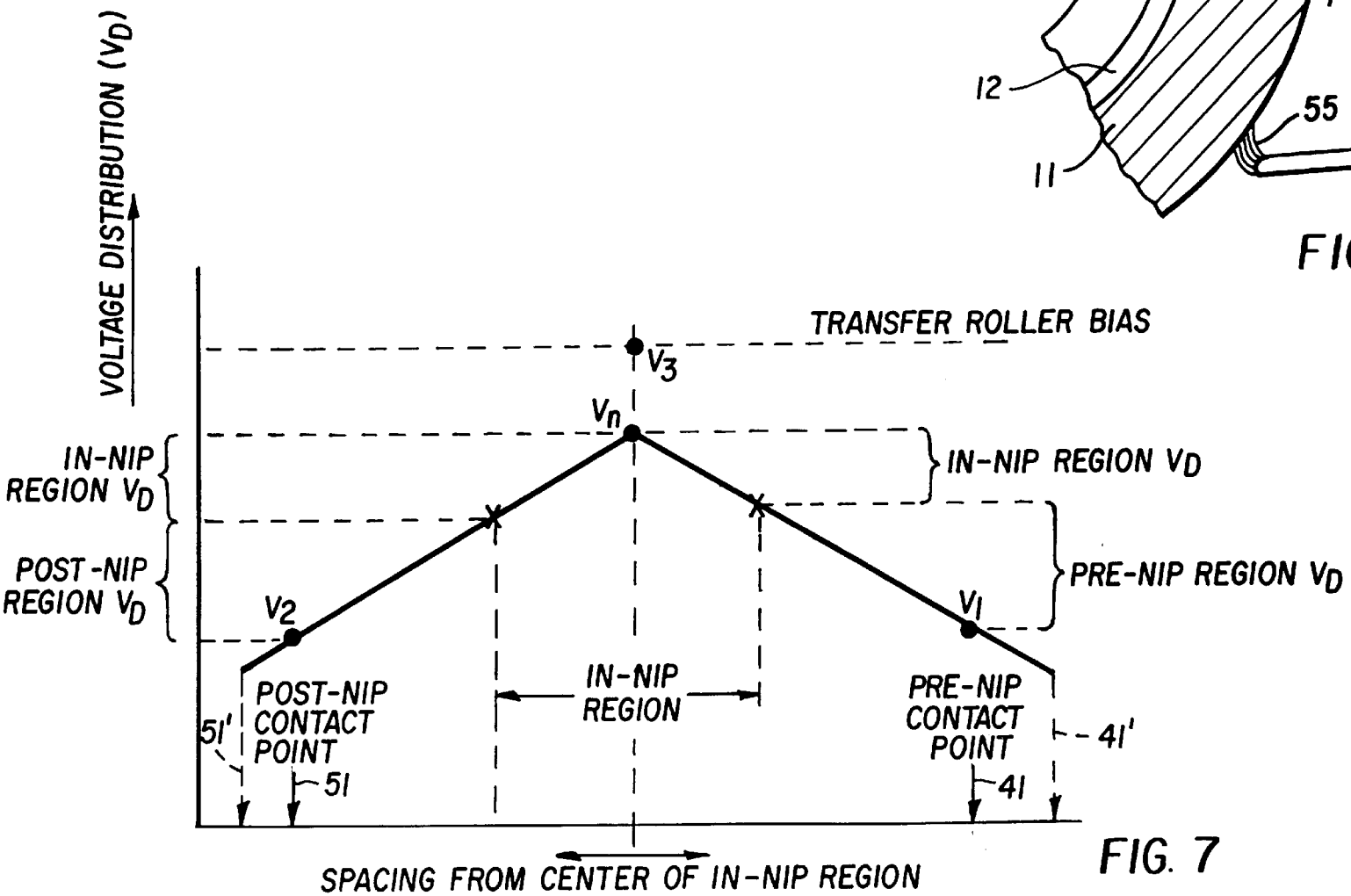
FIG. 7 is a diagram illustrating a relationship between applied contact voltages and voltage distributions in various parts of the transfer roller.

As may be seen in FIG. 7, the resistive outer layer is illustrated as exhibiting respective linear drops in voltage between a point or points on the surface of resistive layer 11 in the in-nip region and contact voltage application points as shown (51, 41) in or proximate the post-nip, pre-nip locations. This illustration is provided to facilitate understanding of the invention and it will be appreciated that the actual relationship may be non-linear because of movement of the members. Charge flows respectively from the inner surface of the resistive outer layer to the respective contact points and establishes a post-nip voltage distribution, a pre-nip voltage distribution and an in-nip voltage distribution. It may be seen in FIG. 7 that the post-nip region voltage distribution (VD) varies depending upon the magnitude of V3, the resistivity of the resistive outer layer 11, the voltage on TIBM 20, the position of application of the respective contact voltage and magnitude of the respective contact voltages. In this regard, it may be seen that the post-nip contact voltage may be applied at points that may be considered outside the post-nip region such as indicated in phantom 51'. However, the further removed from the post-nip region, the lower the applied contact voltage to provide for the same voltage distribution or electrical field in the post-nip region. A similar result may be seen if the pre-nip contact voltage is applied outside of what might be considered the pre-nip region except that the applied contact voltage 41' is lower than if applied within the pre-nip region. While a linear resistive layer characteristic is illustrated, the invention may also be used with resistive layers that exhibit non-linear resistive behavior.

Potentials V1 and V2 are both typically close in magnitude to the surface potential of member 20 (ground potential in FIG. 2), but this is not a requirement. In the nip, there is an average potential Vn at the surface of resistive layer 11 which is established by four potentials: V1, V2, V3 and the surface potential of member 20. Since V3 is a high voltage for urging transfer of toner from member 20 to receiver 30, it is evident that Vn will be lower in magnitude than V3 and higher in magnitude than either V1 or V2. By suitable choices of the resistivity and thickness of layer 11, as well as the physical locations of the contacting blades 51 and 41 or other contact voltage means, a suitable potential Vn can be established during machine operation. Since Vn is the potential which actually urges toner transfer, rather than V3 itself, it is important that the potential difference (here equal to Vn) between the outer surface of resistive outer layer 11 and the surface potential of member 20 be sufficiently large. This can be accomplished by proper choices of bias levels, geometry and materials.

Description of member 20 has been simplified to make the essentials of the invention clearly understandable. In practice, and as is well known to those of ordinary skill in the art, the surface potential of member 20 when in the embodiment of a photoconductor is typically different from the potential of its backing electrode, which is preferably grounded. The surface potential of member 20 can be altered by the presence of latent image charges and charges on toner particles 60, which will require that potentials V1, V2 and V3 each be suitably offset from the potential of the backing electrode of member 20.

Suitable resistivity of compliant resistive layer 11 is in the range of about $10^7$ to about $10^{12}$ ohm-cm, preferably about $10^8$ to about $10^{10}$ ohm-cm. The preferred thickness of compliant resistive layer 11 is in the range of about 5 to about 10 mm. However, the invention contemplates that higher resistivity thin overcoats may be provided and comprise parts of the resistive outer layer.

The contact locations of the blades 51 and 41 or the other contact voltage means are typically a few mm to several cm from either side of the nip.

Thus, in accordance with the invention, the points of application of a contact voltage may be in or proximate the respective region (pre-nip or post-nip) wherein "proximate" implies that the contact voltage has an affect to establish the appropriate voltage distribution within the respective region. The application of the contact voltages at or proximate the pre-nip and post-nip regions in cooperation with a voltage provided from within the transfer roller and the voltage on the TIBM causes a transfer electrical field to be established in the in-nip region. This field varies with position within the nip and its maximum value is preferably about 40 volts per micrometer in the direction of the transfer. The various implementing embodiments feature a transfer roller having a resistive surface that is differentially biased by electrical sources applied externally; i.e., at points on the outer layer of the transfer roller, to the transfer roller's resistive layer so that the pre-nip, in-nip and post-nip regions of the transfer roller have different voltages suited for the transfer operation. The magnitudes of the respective voltages are easily established to suppress pre-nip and post-nip ionization during transfer of toner from a TIBM to a receiver such as paper. In addition, V1 and V2 may be adjusted to account for change in surface potential of the TIBM after toner transfer.

The invention has been described in detail with particular reference to a preferred embodiment thereof, but it will be understood that variations and modifications can be effected within the spirit and scope of the invention.

We claim:

1. A method for electrostatically transferring a toner image from a toner image bearing member to a receiver sheet, the method comprising:

moving a receiver sheet within a nip defined between a toner image-bearing member supporting a toner image and a transfer roller having a conductive inner member and resistive outer layer;

applying an internal voltage to the conductive inner member;

applying a first contact voltage to the resistive outer layer at first points in or proximate to a post-nip region of the transfer roller that is immediately downstream of an in-nip region;

applying a second contact voltage to the resistive outer layer at second points in or proximate to a pre-nip region of the transfer roller that is immediately up-stream of the in-nip region;

applying a voltage to the toner image bearing member; and wherein the internal voltage, the first and second contact voltages, and the voltage on the toner image bearing member cooperate to define an in-nip voltage distribution suitable for transferring the toner image to the receiver sheet and respective pre-nip and post-nip voltage distributions that suppress or minimize pre-nip and post-nip ionization.

2. The method of claim 1 wherein at least one of the first and second contact voltages is applied by an electrically conductive blade that respectively engages the resistive outer layer at the first or second points.

3. The method of claim 2 wherein the resistivity of the resistive outer layer is between about $10^7$ and about $10^{12}$ ohm-cm.

4. The method of claim 1 wherein at least one of the first and second contact voltages is applied by an electrically conductive roller that respectively engages the resistive outer layer at the first or second points.

5. The method of claim 4 wherein the resistivity of the resistive outer layer is between about $10^7$ and about $10^{12}$ ohm-cm.

6. The method of claim 1 wherein at least one of the first and second contact voltages is applied by an electrically conductive brush that respectively engages the resistive outer layer at the first or second points.

7. The method of claim 6 wherein the resistivity of the resistive outer layer is between about $10^7$ and about $10^{12}$ ohm-cm.

8. The method of claim 1 wherein at least one of the first and second contact voltages is applied by a corona charger that respectively deposits charge upon the resistive outer layer at the first or second points.

9. The method of claim 8 wherein the resistivity of the resistive outer layer is between about $10^7$ and about $10^{12}$ ohm-cm.

10. The method of claim 1 wherein the resistivity of the resistive outer layer is between about $10^7$ and about $10^{12}$ ohm-cm.

11. The method of claim 1 wherein the resistivity of the resistive outer layer is between about $10^8$ and about $10^{10}$ ohm-cm.

12. The method of claim 1 wherein the toner image is a multicolored image.

13. The method of claim 1 wherein the first and second contact voltages are each applied across a full working length of the transfer roller.

14. An apparatus for electrostatically transferring a toner image from a toner image bearing member to a receiver sheet, the apparatus comprising:

a movable toner image bearing member supporting a toner image and biased to a first voltage level;

a rotatable transfer roller located proximate the toner image bearing member so as to cooperate with the toner image bearing member to define a toner transfer nip for transferring the toner image to a receiver sheet moving within the nip, the transfer roller having a resistive outer layer and a conductive inner member that is electrically biased to a second voltage level;

a first contact voltage applicator applying a first contact voltage to the resistive outer layer at first points in or proximate a post-nip region to establish a post-nip electrical voltage distribution in the post nip region of the transfer roller that is immediately downstream of an in-nip region of the transfer roller;

a second contact voltage applicator applying a second contact voltage to the resistive outer layer at second points in or proximate a pre-nip region to establish a pre-nip electrical voltage distribution in the pre-nip region of the transfer roller that is immediately up-stream of the in-nip region; and the first voltage level, the second voltage level and the first and second contact voltages establishing an in-nip voltage distribution suitable for transferring the toner image to the receiver sheet.

15. The apparatus of claim 14 wherein at least one of the first applicator and the second applicator is an electrically conductive blade that respectively engages the resistive outer layer at the first or second points.

16. The apparatus of claim 15 wherein the resistivity of the resistive outer layer is between about $10^7$ and about $10^{12}$ ohm-cm.

17. The apparatus of claim 14 wherein at least one of the first applicator and the second applicator is an electrically conductive roller that respectively engages the resistive outer layer at the first or second points.

18. The apparatus of claim 17 wherein the resistivity of the resistive outer layer is between about $10^7$ and about $10^{12}$ ohm-cm.

19. The apparatus of claim 14 wherein at least one of the first applicator and the second applicator is an electrically conductive brush that respectively engages the resistive outer layer at the first or second points.

20. The apparatus of claim 19 wherein the resistivity of the resistive outer layer is between about $10^7$ and about $10^{12}$ ohm-cm.

21. The apparatus of claim 14 wherein at least one of the first applicator and the second applicator is a corona charger that respectively deposits charge upon the resistive outer layer at the first or second points.

22. The apparatus of claim 14 wherein the resistivity of the resistive outer layer is between about $10^7$ and about $10^{12}$ ohm-cm.

23. The apparatus of claim 14 wherein the resistivity of the resistive outer layer is between about $10^8$ and about $10^{10}$ ohm-cm.

24. An apparatus for electrostatically transferring a toner image from a toner image bearing member to a receiver sheet, the apparatus comprising:

a movable toner image bearing member supporting a toner image and biased to a first voltage level;

a rotatable transfer roller located proximate the toner image bearing member so as to cooperate with the toner image bearing member to define a toner transfer nip for transferring the toner image to a receiver sheet moving within the nip, the transfer roller having a resistive outer layer and a conductive inner member that is electrically biased to a second voltage level;

first means for applying a first contact voltage to the resistive outer layer at first points in or proximate a post-nip region to establish a post-nip electrical voltage distribution in the post nip region of the transfer roller that is immediately downstream of an in-nip region of the transfer roller;

second means for applying a second contact voltage to the resistive outer layer at second points in or proximate a pre-nip region to establish a pre-nip electrical voltage distribution in the pre-nip region of the transfer roller that is immediately up-stream of the in-nip region; and the first voltage level, the second voltage level and the first and second contact voltages establishing an in-nip voltage distribution suitable for transferring the toner image to the receiver sheet.

* * * * *